US006283042B1

(12) United States Patent
Wargo et al.

(10) Patent No.: US 6,283,042 B1
(45) Date of Patent: Sep. 4, 2001

(54) HIGHCHAIR TRAY ATTACHMENT

(76) Inventors: Kathie D. Wargo; Walter E. Poe, both of 22746 Cavalier St., Woodland Hills, CA (US) 91364

( * ) Notice: Subject to any disclaimer, the term of this patent is extended or adjusted under 35 U.S.C. 154(b) by 0 days.

(21) Appl. No.: 09/054,891

(22) Filed: Apr. 3, 1998

(51) Int. Cl.[7] ..... A47B 85/00
(52) U.S. Cl. ..... 108/26; 297/188.2
(58) Field of Search ..... 108/26, 25, 152; 297/188.18, 188.2; 248/309.1, 311.2

(56) References Cited

U.S. PATENT DOCUMENTS

| | | | | |
|---|---|---|---|---|
| 2,210,972 | | 8/1940 | Christenson . | |
| 2,457,285 | * | 12/1948 | Stepner | 108/26 |
| 2,707,141 | * | 4/1955 | Witter | 108/26 |
| 3,146,738 | | 9/1964 | Telarico . | |
| 3,271,070 | * | 9/1966 | Dlouhy et al. | 108/26 X |
| 4,927,024 | | 5/1990 | Lloyd . | |
| 5,010,826 | | 4/1991 | Kudlac . | |
| 5,087,097 | | 2/1992 | Hehn . | |
| 5,092,549 | * | 3/1992 | Beech | 297/188.2 X |
| 5,295,650 | * | 3/1994 | Brandt | 108/26 X |
| 5,348,374 | | 9/1994 | Kuo . | |
| 5,356,107 | * | 10/1994 | Sinohuiz | 297/188.18 X |
| 5,586,800 | | 12/1996 | Triplett . | |
| 5,671,686 | * | 9/1997 | Hurley et al. | 108/26 X |

FOREIGN PATENT DOCUMENTS

| | | | | |
|---|---|---|---|---|
| 596438 | * | 8/1925 | (FR) | 108/26 |

* cited by examiner

*Primary Examiner*—Jose V. Chen
(74) *Attorney, Agent, or Firm*—Jack C. Monro; William H. Maxwell

(57) ABSTRACT

An attachment for a highchair tray provides a clamping bracket adapted to be fixed to a depending front flange of the tray or other desired loacation, characterized by an extended arm with a declined mounting plate remotely positioning a food server so as to not permit access to the server by the child, the clamping bracket removably receiving the arm. The server is integral with the arm and/or mounting plate or can be mounted onto the arm or mounting plate or as a receiving chamber to support a food container remote from the child.

8 Claims, 1 Drawing Sheet

HIGHCHAIR TRAY ATTACHMENT

BACKGROUND OF THE INVENTION

1) Field of the Invention

The field of this invention relates to an attachment for a highchair tray and more particularly to an attachment which can be readily attached to and detached from the highchair tray. The attachment locating food servings so as not to be accessible by a child and to be dispensed to the child seated in the highchair.

2) Description of the Prior Art

It is common to use a highchair in conjunction with small children during feeding of the child. A highchair is normally characterized by four relatively long, upright legs which are jointed and cross-braced in various manners to provide an elevated seat as when compared with a conventional chair. Characteristically, a highchair has mounted thereon a removable tray which is to function to enclose over the lap of the child when taken in conjunction with the arms of the highchair as well as the back of the highchair when serving food to the child. It is common to include some type of a securing strap to ensure that the child is positively restrained when located within the highchair.

It is known that children are likely to tip over food servers such as jars and dishes which contain food, this tipping over commonly occurring on the highchair tray and even off of the highchair tray. It is common that after feeding of a small child from a highchair that not only must the highchair be cleaned of food droppings, but also the surrounding floor area. In the past, numerous devices have been developed in an effort to prevent this type of food spillage, such as liquid containers that can only dispense liquid when the liquid is being sucked from the container and the liquid not being pourable therefrom. However, when it comes to solid food, the preferred procedure has been to locate the solid food out of the reach of the child with the child then to be fed by utensils, such as a spoon, small portions of the solid food until it is eventually totally consumed. The locating of the liquid or solid food containers or servers generally requires as individual who is feeding the child to physically support the food containers or servers in the individual's hands or located at a table spaced some distance from the highchair. This type of arrangement is not particularly convenient and especially when containers are supported by a hand of the individual feeding the child, so that the hand is not free to be used in assisting of the feeding operation of the child.

There is a need to provide an attachment for a highchair tray in which the food can be mounted in conjunction with the highchair tray but cannot be swept off the tray by the child.

SUMMARY OF THE INVENTION

The structure of the present invention provides for an attachment which includes a clamping bracket means which can be removably and securably mounted in conjunction with the peripheral edge of a highchair tray. This clamping bracket means includes a slot which receives and supports a server or holders for the jars and the dishes and the like. The slot includes a ledge, there being an arm with a protuberance that is positioned against the inside surface of the ledge with the result that the ledge and protuberance function as a stop locating the mounting position of the arm within the slot. Mounted at the outer forward end of the arm there is a receiver comprised of one or more cylindrical cavities and each cavity is of a size adapted to contain food or to support a jar or dish of baby food. Instead of the cavities for receiving jars and/or dishes, the arm is provided one or more food receiving compartments. Accordingly, there is one or more food server means carried by the arm.

The primary objective of the present invention is to provide an attachment for a highchair tray which will permit the locating of food that is to be served to a child seated within the highchair and in a location directly adjacent to the child but yet at a distance that is far enough away from the child so as to prevent the child from reaching and coming into contact with any food or food containers mounted on the attachment. Accordingly, said arm of the bracket is an extension for support of the food server means.

Another objective of the present invention is to provide an attachment which can be manufactured relatively inexpensively and therefore sold relatively inexpensively to the consumer.

Another objective of the present invention is to provide an attachment which can be universally mounted to any tray of any manufactured highchair.

DETAILED DESCRIPTION OF THE PREFERRED EMBODIMENT

Figures 1, 2, 3, 4:
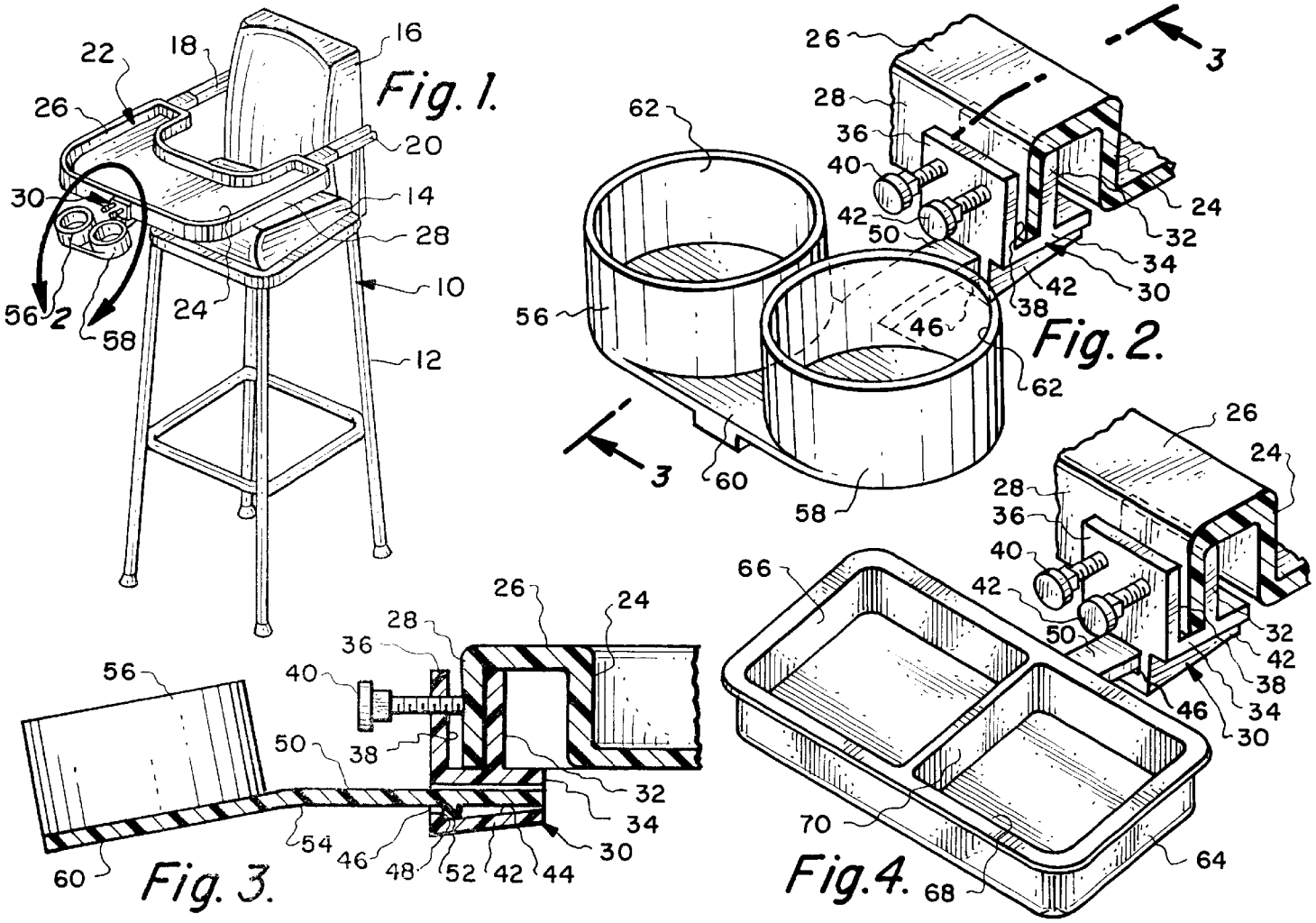
FIG. 1 is an isometric view of a typical highchair upon which is mounted the attachment of the present invention.
FIG. 2 is an isometric view of the attachment mounted in conjunction with the highchair tray as shown in FIG. 1.
FIG. 3 is a cross-sectional view taken along line 3—3 in FIG. 2.
FIG. 4 is an isometric view showing a modified second embodiment form of food server in lieu of the holders shown in FIGS. 1–3.

Referring particularly to the drawing, there is shown a typical highchair 10 which has four legs 12 at the upper end of which is fixedly mounted a seat 14. Mounted at the rear of seat 14 is a seat back 16. Mounted on each side of the seat back 16 are arms 18 and 20. Mounted in conjunction with the arms 18 and 20 is a highchair tray 22. The highchair tray 22 defines a large recess 24 formed within the upper surface of the tray 22. The recess 24 is formed within a peripheral edge 26 of the tray and characterized by a front, downwardly, depending, flange 28.

The attachment of the present invention utilizes a clamping bracket means 30. The clamping bracket means 30 includes a back plate 32 which is mounted on a base plate 34. Also mounted on the base plate 34 and located parallel to the back plate 32 is a front plate 36. A gap area 38 is formed between the front plate 36 and the back plate 32. A front portion of the depending flange 28 is positioned within the gap area 38 as is clearly shown in FIGS. 2–4 of the drawings.

Threadedly mounted through the front plate 36 is one or more and preferably a pair of set screws 40 and 41. The inner ends of the set screws 40 and 41 are tightly against the flange 28 thereby fixedly securing in position the clamping bracket means 30 onto the highchair tray 22. Fixedly mounted onto the base plate 34 is a subbase plate 42. Subbase plate 42 is spaced from the base 34 forming a slot 44 which has a front access opening 46. Carried by the subbasse plate 42 the access opening 46 is a ledge 48 comprised a raised section extending upward from the subbase plate 42.

A seperable support arm 50 is locatable within the slot 44 as is clearly shown in FIGS. 2–4 of the drawing. The arm 50 includes a protrusion 52, the height of the access opening 46 being large enough so as to permit passage of the thickness of the arm 50 and the added height of the protrusion 52 for its insertion into the slot 44. In practice when the arm is inserted within the slot 44 it is released so as to fall by gravity which will cause the protrusion 52 to drop behind and oppose the ledge 43 and come to rest against the subbase plate 42 or alternativly rest upon the ledge 48. As clearly shown FIG. 3, the rearwardly extending portion of arm 50 functions as a first class lever with its terminal end bearing upwardly against the base plate 34 and its fulcrum at the ledge 48. This arm and slot engagement functions to lock the arm 50 in position relative to the clamping bracket means 30 and will prevent any accidental disengagement therebetween. The only way that the arm 50 can be disengaged from the clamping bracket means 30 is for the arm 50 to be raised which will permit the protrusion 52 to pass over the ledge 48 and be withdrawn from the slot 44 permitting the arm 50 to be completely disengaged from the clamping bracket means 30.

The arm 50 is downwardly bent at 52 and forwardly extending. Mounted on the outer forwardly extended declined end portion of the arm 50 is a food server means, preferably a pair of cylindrical rings 56 and 58 forming pockets 62. The rings 56 and 58 are mounted on a forwardly extending mounting plate 60 of the arm 50. Each of the rings 56 and 58 forms a food receiver chamber 62. Within each receiving chamber 62 there is capable of being located a food storage container such as a jar or dish (not shown). The reason for the bend 54 and declined plate 60 is to dispose the server means in a slight downwardly and forwardly declined angle which orients the jars at a significantly more accessible position in order to facilitate removal of the food from the pocket, jars or dishes as by means of a spoon or other type of utensil, the food then being fed to the child seated on the seat 14. The mouths (not shown) of the jars actually lean toward the person extracting the food making it easier to do so. The upper surface of the mounting plate 60, upon which the rings 56 and 58 are mounted, is at an obtuse angle relative to the clamping bracket means 30.

Referring to FIG. 4 of the drawings, a second embodiment is shown wherein a different food server means such as a compartmented server 64 is integrally mounted on the arm 50. The server 64 includes a pair of food receiving compartments 66 and 68. The compartments 66 and 68 are separated by a barrier wall 70. The food is directly deposited within the compartments 66 and 68. The server after usage is removable from the clamping bracket means for cleaning etc.

It is to be understood that equivalent configurations of food supporting devices can be utilized other than the rings 56 and 58 and compartmented server 64. It is also to be understood that the clamping bracket means 30 and extended arm 50 are to be mounted on the flange 28 so as to remotley position the food server which makes it difficult and practically impossible for the child to reach over and come into contact with either the food contained within the food server 64 or the jars or dishes of food that are mounted in conjunction with the rings 56 and 58. It is also to be understood that the bend and declined support 60 is utilized in conjunction with either embodiment of this invention.

What is claimed is:

1. An attachment for a highchair tray disposed over the lap of a child seated in a highchair, said tray having a depending front flange, the attachment including;

a clamping bracket means for fixed attachment to the depending front flange of the highchair tray and having a base plate and an underlying subbase plate spaced from said base plate and forming a forwardly opening slot, an arm having a rear portion releasably inserted into said forwardly opening slot and having a forwardly extending mounting plate, and a food server means carried by said forwardly extending mounting plate of the arm and out of reach from said child.

2. The attachment for a highchair tray as set forth in claim 1, wherein the clamping bracket means is comprised of spaced and parallel front aged back plates and one of which bears against one side of said flange and the other of which threadedly carries a set screw to bear against the other side of said flange.

3. The attachment for a highchair tray as set forth in claim 1, wherein the clamping bracket means for said fixed attachment includes a front access opening into the slot, the rear portion of said arm entering through said access opening and bearing upwardly against the base plate while supported by the subbase plate at the access opening.

4. The attachment for a highchair tray as set forth in claim 1, wherein the clamping bracket means for said fixed attachment includes, a front access opening into the slot, there being a ledge comprised of a raised section extending upward from the subbase plate, the rear portion of the arm extending rearwardly through the slot and bearing upwardy against the base plate while supported by the subbase plate at said access opening, there being a protrusion depending from and spaced forwardly from the rear end of said arm and having stopped engagement against said ledge.

5. The attachment for a highchair tray as set forth in claim 1, wherein the food server means is a container replacable upon the forwardly extending mounting plate of the arm.

6. The attachment for a highchair tray as set forth in claim 1, wherein the food server means is a pocket on the forwardly extending mounting plate of the arm.

7. The attachment for a highchair tray as set forth in claim 1, wherein the food server means is a pocket receiving a replacable food container on the forwardly extending mounting plate of the arm.

8. The attachment for a highchair tray as set fourth in claim 1, wherein said forwardly extending mounting plate of the arm is bent downwardly from said rear portion thereof and forwardly declined for disposition away from the child and for facilitating access into the food server means.

* * * * *